US008211203B2

(12) United States Patent
Sheng et al.

(10) Patent No.: US 8,211,203 B2
(45) Date of Patent: Jul. 3, 2012

(54) MATRIX POWDER FOR MATRIX BODY FIXED CUTTER BITS

(75) Inventors: Xiayang Sheng, Sugar Land, TX (US); Alan W. Lockstedt, Magnolia, TX (US); Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 833 days.

(21) Appl. No.: 12/189,992

(22) Filed: Aug. 12, 2008

(65) Prior Publication Data

US 2009/0260893 A1 Oct. 22, 2009

Related U.S. Application Data

(60) Provisional application No. 61/046,293, filed on Apr. 18, 2008.

(51) Int. Cl.
*B22F 1/00* (2006.01)

(52) U.S. Cl. ..... 75/252; 175/374

(58) Field of Classification Search ..... 75/240, 75/252; 175/374

See application file for complete search history.

(56) References Cited

U.S. PATENT DOCUMENTS

| | | | | |
|---|---|---|---|---|
| 3,379,503 | A | 4/1968 | McKenna | |
| 4,723,996 | A | 2/1988 | Brunet et al. | |
| 4,834,963 | A | 5/1989 | Terry et al. | |
| 5,071,473 | A * | 12/1991 | Reeder et al. | 75/240 |
| 5,089,182 | A | 2/1992 | Findeisen et al. | |
| 5,541,006 | A | 7/1996 | Conley | |
| 5,589,268 | A | 12/1996 | Kelley et al. | |
| 5,662,183 | A | 9/1997 | Fang | |
| 5,733,649 | A | 3/1998 | Kelley et al. | |
| 5,733,664 | A | 3/1998 | Kelley et al. | |
| 5,765,095 | A | 6/1998 | Flak et al. | |
| 5,880,382 | A | 3/1999 | Fang et al. | |
| 6,221,479 | B1 | 4/2001 | Waldenstrom et al. | |
| 6,287,360 | B1 | 9/2001 | Kembaiyan et al. | |
| 6,908,688 | B1 | 6/2005 | Majagi et al. | |
| 7,250,069 | B2 | 7/2007 | Kembaiyan et al. | |
| 7,398,840 | B2 | 7/2008 | Ladi et al. | |
| 2005/0211475 | A1 | 9/2005 | Mirchandani et al. | |
| 2005/0247491 | A1 | 11/2005 | Mirchandani et al. | |
| 2006/0032335 | A1 | 2/2006 | Kembaiyan | |
| 2007/0079992 | A1 | 4/2007 | Curry et al. | |
| 2007/0102200 | A1 | 5/2007 | Choe et al. | |
| 2007/0277646 | A1 | 12/2007 | Terry et al. | |

FOREIGN PATENT DOCUMENTS

| | | |
|---|---|---|
| GB | 2434590 | 8/2007 |
| JP | 9125185 | 5/1997 |
| WO | 00/03049 | 1/2000 |
| WO | 2007/041606 A2 | 4/2007 |
| WO | 2009129492 A2 | 10/2009 |

OTHER PUBLICATIONS

International Search Report and Written Opinion of the International Searching Authority for International Application No. PCT/US2009/041014, mailed on Nov. 30, 2009 (11 pages).

United Kingdom Search Report for Application No. GB0906694, mailed on Jun. 3, 2009 (4 pages).

"Modeling the Relationship between microstructural features and the strength of Wc-Co Composites" by: Chang-Soo Kim et al. International Journal of Refractory Materials and Hard Material vol. 24 (2006) 89-100.

United Kingdom Examination Report issued in related GB Application No. GB0906694.5; Dated Jan. 18, 2012 (3 pages).

* cited by examiner

*Primary Examiner* — Roy King
*Assistant Examiner* — Ngoclan T Mai
(74) *Attorney, Agent, or Firm* — Osha • Liang LLP

(57) ABSTRACT

A matrix powder for forming a matrix bit body, the matrix powder essentially consisting of a plurality of carbide particles having a particle size distribution of ±20% of a median particle size; and a plurality of metal binder particles is disclosed.

6 Claims, 5 Drawing Sheets

MATRIX POWDER FOR MATRIX BODY FIXED CUTTER BITS

CROSS-REFERENCE TO RELATED APPLICATIONS

This application claims priority under 35 U.S.C. §119(e) to U.S. Patent Application No. 61/046,293 filed on Apr. 18, 2008, which is herein incorporated by reference in its entirety.

BACKGROUND OF INVENTION

1. Field of the Invention

Embodiments disclosed herein relate generally to a composition for the matrix body of rock bits and other cutting or drilling tools.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters is mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance as compared to steel bit bodies. The matrix bit generally is formed by packing a graphite mold with tungsten carbide powder and then infiltrating the powder with a molten copper-based alloy binder. There are several types of tungsten carbide that have been used in forming matrix bodies, including macrocrystalline tungsten carbide, cast tungsten carbide, carburized (or agglomerated) tungsten carbide, and cemented tungsten carbide. Macrocrystalline tungsten carbide is essentially stoichiometric WC which is, for the most part, in the form of single crystals; however, some large crystals of macro-crystalline WC are bi-crystals. Carburized tungsten carbide has a multi-crystalline structure, i.e., they are composed of WC agglomerates.

Cast tungsten carbide, on the other hand, is formed by melting tungsten metal (W) and tungsten monocarbide (WC) together such that a eutectic composition of WC and $W_2C$, or a continuous range of compositions therebetween, is formed. Cast tungsten carbide typically is frozen from the molten state and comminuted to a desired particle size. The last type of tungsten carbide, which has been typically used in hardfacing, is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing.

Bit bodies formed from either cast or macrocrystalline tungsten carbide or other hard metal matrix materials, while more erosion resistant than steel, lack toughness and strength, thus making them brittle and prone to cracking when subjected to impact and fatigue forces encountered during drilling. This can result in one or more blades breaking off the bit causing a catastrophic premature bit failure. The formation and propagation of cracks in the matrix body may result in the loss of one or more PDC cutters. A lost cutter may abrade against the bit, causing further accelerated bit damage. However, bits formed with sintered tungsten carbide may have sufficient toughness and strength for a particular application, but may lack other mechanical properties, such as erosion resistance. Thus, previous efforts have instead relied on combinations of materials to achieve a balance of properties. Additionally, use of materials having wide particle size distributions have been relied upon so as to achieve a close packing of the carbide wear particles to increase wear resistance.

Accordingly, there exists a need for a new matrix body composition for drill bits which has high strength and toughness, resulting in improved ability to retain blades and cutters, while maintaining other desired properties such as wear and erosion resistance.

SUMMARY OF INVENTION

In one aspect, embodiments disclosed herein relate to a matrix powder for forming a matrix bit body, the matrix powder essentially consisting of a plurality of carbide particles having a particle size distribution of ±20% of a median particle size; and a plurality of metal binder particles.

In another aspect, embodiments disclosed herein relate to a matrix powder for forming a matrix bit body, the matrix powder essentially consisting of a plurality of carbide particles, wherein 90% of the plurality of carbide particles have a particle size within 20% of a median particle size of the plurality of carbide particles; and a plurality of metal binder particles.

In another aspect, embodiments disclosed herein relate to a drill bit that includes a bit body having a plurality of blades extending radially therefrom, at least a portion of the plurality of blades comprises a first matrix region comprising a plurality of first carbide particles separated by a first binder phase, wherein the plurality of first carbide particles have a mean free path of greater than about 40 microns; and at least one cutting element for engaging a formation disposed on at least one of the plurality of blades.

Other aspects and advantages of the invention will be apparent from the following description and the appended claims.

DETAILED DESCRIPTION

Figure 1A:
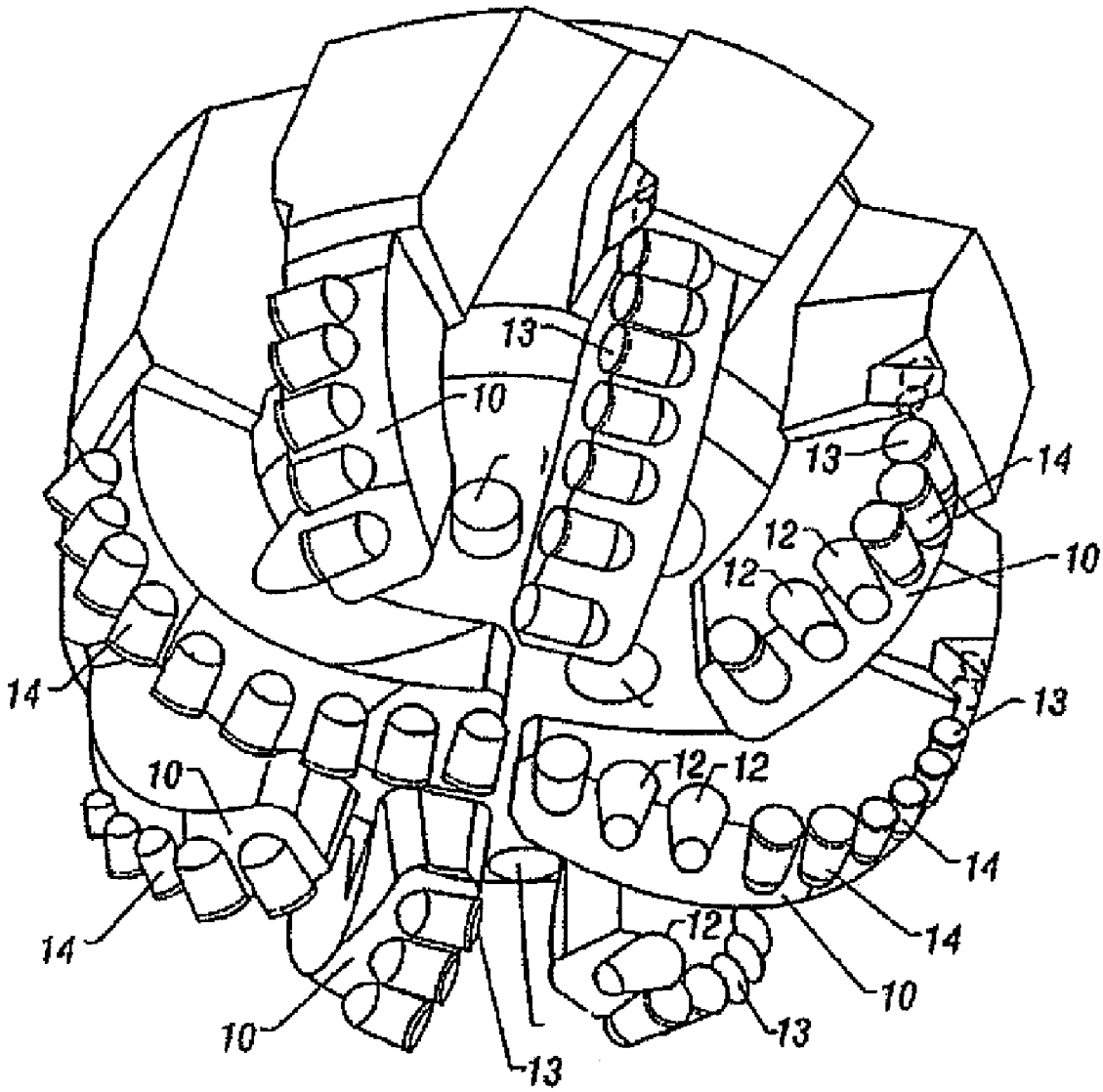
FIG. 1A is a perspective view of an earth boring PDC drill bit body with some cutters in place according to an embodiment.

Embodiments of the present disclosure provide for matrix powder compositions suitable for forming bit bodies. In addition, embodiments of the present disclosure provide matrix bodies which are formed from such carbide matrix powders infiltrated by suitable metals or alloys as infiltration binders. Such a matrix body has high strength and toughness while maintaining desired braze strength and wear resistance.

The invention is based, in part, on the determination that the life of a matrix bit body is related to the body's strength, toughness, and resistance to wear and erosion. For example, cracks often occur where the cutters (typically polycrystalline diamond compact—"PDC" cutters) are secured to the matrix body, or at the base of the blades. The ability of a matrix bit body to retain the blades is measured in part by its transverse rupture strength. The drill bit is also subjected to varying degrees of impact and fatigue loading while drilling through earthen formations of varying hardness. It is important that the bit possesses adequate toughness to withstand such impact and fatigue loading. Additionally, during drilling processes, drilling fluids, often laden with rock cuttings, can cause erosion of the bit body. Thus, it is also important that the matrix body material be sufficiently erosion resistant to withstand degradation caused by the surrounding erosive environment.

In particular, while conventional attempts to improve the wear properties of matrix bit bodies used wide particle size distributions to increase the packing efficiency of the wear resistant carbide particles (by filling smaller carbide particles into the spaces between larger carbide particles resulting in greater carbide-carbide particle contact), the present disclosure is instead directed to techniques for balancing toughness and wear resistance by using narrow particle size distributions. Such narrow size distributions result in better (greater and more uniform) spacing between particles, more even distribution of carbide particles throughout the binder phase, and less carbide-carbide particle contact. As used herein, the term "even" distribution simply means that the carbide particles are more uniformly distributed throughout the binder phase when compared with similar prior art samples.

The relative distribution of carbide particles in the binder phase of the matrix may be measured using several different methods. First, the distribution may be discussed in terms of carbide "contiguity," which is a measure of the number of carbide particles that are in direct contact with other carbide particles. Ideally, if complete distribution existed, the carbide to carbide contiguity would be 0% (i.e., no two carbide particles are in direct contact). Matrix bodies formed in accordance with the matrix powders of the present disclosure may possess a contiguity significantly less than that achieved for a typical matrix body The carbide contiguity may be determined as follows:

$$C_{C\text{-}C}=(2P_{C\text{-}C})/(2P_{C\text{-}C}+P_{C\text{-}M}) \quad \text{(Eq. 1)}$$

where $P_{C\text{-}C}$ equals the total number of contiguous points of carbide along the horizontal lines of a grid placed over a sample photo, and $P_{C\text{-}M}$ equals the total number of points where carbide particles contact matrix. Second, the carbide distribution may be discussed in terms of the mean free path, which represents the mean distance between carbide particles. Using this metric, the larger the mean free path (for a given carbide concentration) the more evenly distributed the carbide particles are. In accordance with embodiments of the present disclosure, an improved mean free path may result from the particle size distributions used in forming matrix body bits.

To decrease carbide contiguity, a better spacing between particles (less efficient packing) is desired. Thus, while conventional wisdom in matrix bit design has indicated that a wide particle size distribution is desirable to fill "pore" spaces between larger carbide particles with smaller carbide particles (increasing packing efficiency) in order increase wear resistance, the present disclosure uses a relatively narrow particle size distribution, resulting in a lower packing efficiency. However, such narrow distribution is desirable to prevent carbide-carbide contact. When a bit is subjected to typical loads during drilling, reduction in carbide-carbide contact may result in a bit less prone to cracking (and propagation of cracking). On skilled in the art would appreciate that the total range of carbide-to-carbide distances may vary; however, a mean free path may reflect the general distribution of carbides through the body. In accordance with one embodiment of the present disclosure, the mean free path may be greater than about 40 microns, greater than about 50 microns in another embodiment, and greater than about 60 microns in yet another embodiment. One skilled in the art would appreciate that the mean free path may depend, to some extent, on the volume of carbide particles in the total body. Thus, such mean free paths values listed above may reflect the mean free path of carbide particles where the carbide content ranges from 45 to 65 by volume of the total matrix body.

Particle size distribution may be expressed as being with a certain sigma from a median particle size. Thus, in a particular embodiment, the particle size distribution of the matrix powder may be within ±20%, and ±15% in another embodiment, of the median particle size. Alternatively, the matrix powder may have 90% of the carbide particles within 20% of a median particle size, and within 15% or 10% of the median particle size in other embodiments. In yet another embodiment, the matrix powder may have 95% of the carbide particles within 20% of a median particle size, and within 15% or 10% of the median particle size in yet other embodiments Further, carbide particles are often measured in a range of mesh sizes, for example −40+80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the carbide particles is defined by the largest and smallest grade of mesh used to screen the particles. Carbide particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm. Thus, use of mesh screening may allow for an easy determination of particle size distribution. Exemplary mesh sizes may include −230+325, −200+270, −170+230, −140+200, −120+170, −100+140, −80+120, −70+100, −60+80, −50+70. Further, one skilled in the art would appreciate that uniformly sized matrix powder may be taken from either end of the size spectrum, including fine or coarse particles. For example, in a particular embodiment, the matrix powder may have a mean particle size ranging from about 50 to about 840 microns.

Further, one skilled in the art would appreciate that wear properties may be optimized by selection of the particle or mesh size, and also by selection of tungsten carbide type. For example, it is typically observed that the wear resistance increases as the grain size of tungsten carbide decreases. Conversely, toughness typically increases as grain size increases. Moreover, among the types of tungsten carbide, some types are known as being more wear resistant than others, while the others may have greater contribution to toughness.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. The agglomerates form grains that are larger than individual WC crystals. These larger grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H.C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide particles are commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 5 μm. In some embodiments, the amount of cobalt present in the cemented tungsten carbide is such that the cemented carbide is comprised of from about 6 to 8 weight percent cobalt. In other embodiments, the cemented tungsten carbide used in the mixture of tungsten carbides to form a matrix bit body may have a hardness ranging from about 90 to 92 Rockwell A.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. Thus, for example, the cast tungsten carbide used in the mixture of tungsten carbides may be comprised of from about 3.7 to about 4.2 weight percent carbon.

Thus, one skilled in the art would appreciate that the various tungsten carbides disclosed herein may be selected so as to provide a bit that is tailored for a particular drilling application. For example, the type (e.g., cast, cemented, or macrocystalline tungsten carbide), shape, and/or size of carbide particles used in the formation of a matrix bit body may affect the material properties of the formed bit body, including, for example, fracture toughness, transverse rupture strength, and wear and erosion resistance. In a particular embodiment, either spherical or crushed cast tungsten carbide may be used in the matrix powder of the present disclosure.

In a bit body, the tungsten carbide particles may be surrounded by a metallic binder. The metallic binder may be formed from a metallic binder powder and an infiltration binder. The metallic binder powder may be pre-blended with the matrix powder hard carbide particles. To manufacture a bit body, matrix powder is infiltrated by an infiltration binder. The term "infiltration binder" herein refers to a metal or an alloy used in an infiltration process to bond the various particles of tungsten carbide forms together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, may also be present in the infiltration binder. In one preferred embodiment, the infiltration binder is selected from at least one of nickel, copper, and alloys thereof. In another preferred embodiment, the infiltration binder includes a Cu—Mn—Ni—Zn alloy.

Thus the matrix powder may consist essentially of a mixture of tungsten carbide particles and metallic binder particles. In one embodiment, nickel and/or iron powder may be present as the balance of the matrix powder, in an amount ranging from about 6% to 16% by weight. In a particular embodiment, nickel and/or iron powder may form about 8 to 12% by weight of the matrix powder. However, one skilled in the art would appreciate that in addition to nickel and/or iron, other Group VIIIB metals such as cobalt and various alloys may also be used. Metal addition in the range of about 8% to about 12% may yield higher matrix strength and toughness, as well as higher braze strength.

By using matrix powders of the present disclosure, once infiltrated to form a matrix body (or region), the final binder (infiltrant and powder) content of the matrix region may range from about 35 to 55 percent by volume. In another embodiment, the final binder content may range from about 40 to 50 percent by volume. An alternatively way of expressing the binder content may be by looking at the area fraction, which, may be estimated, for example, from SEMs of a resulting matrix body. Further, with a sufficient number of cross-sections, one skilled in the art would appreciate that the volume fraction may be estimated from the area fraction.

Further, while reference is made to tungsten carbide, one skilled in the art would appreciate that other carbides of Group 4a, 5a, or 6a metals may also be used. Further, one skilled in the art would also appreciate that the total carbide content may be at least 80%, preferably 85 or 90% by weight of the matrix powder prior to infiltration, such matrix bodies with lower carbide contents may not possess the desired physical properties to yield optimal performance.

The matrix body material in accordance with embodiments of the invention has many applications. Generally, the matrix body material may be used to fabricate the body for any earth-boring bit which holds a cutter or a cutting element in place. Earth-boring bits that may be formed from the matrix bodies disclosed herein include PDC drag bits, diamond coring bits, impregnated diamond bits, etc. These earth-boring bits may be used to drill a wellbore by contacting the bits with an earthen formation.

Figure 1B:
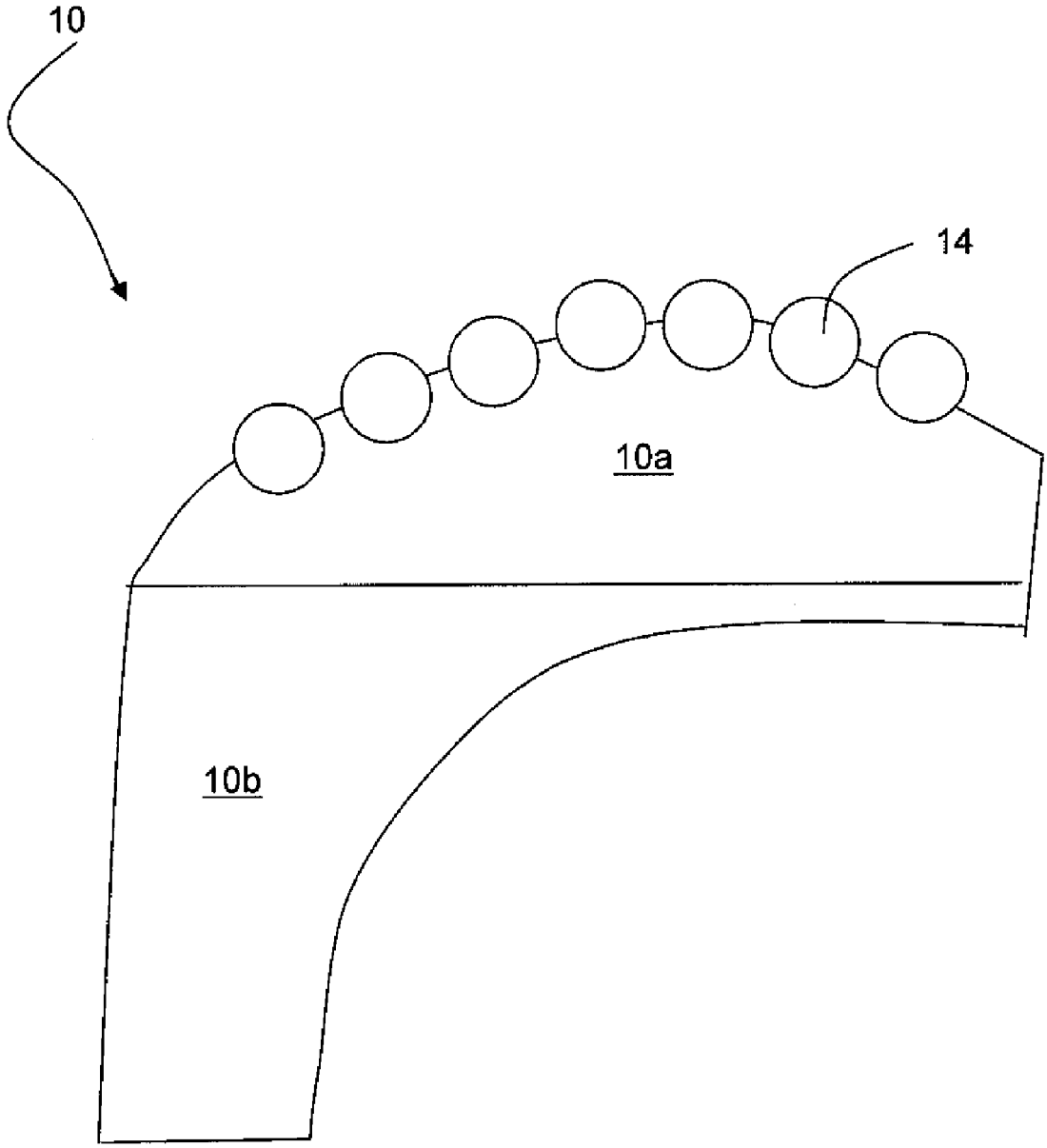
FIG. 1B shows a cross-sectional view of a blade in accordance with one embodiment.
Figure 2:
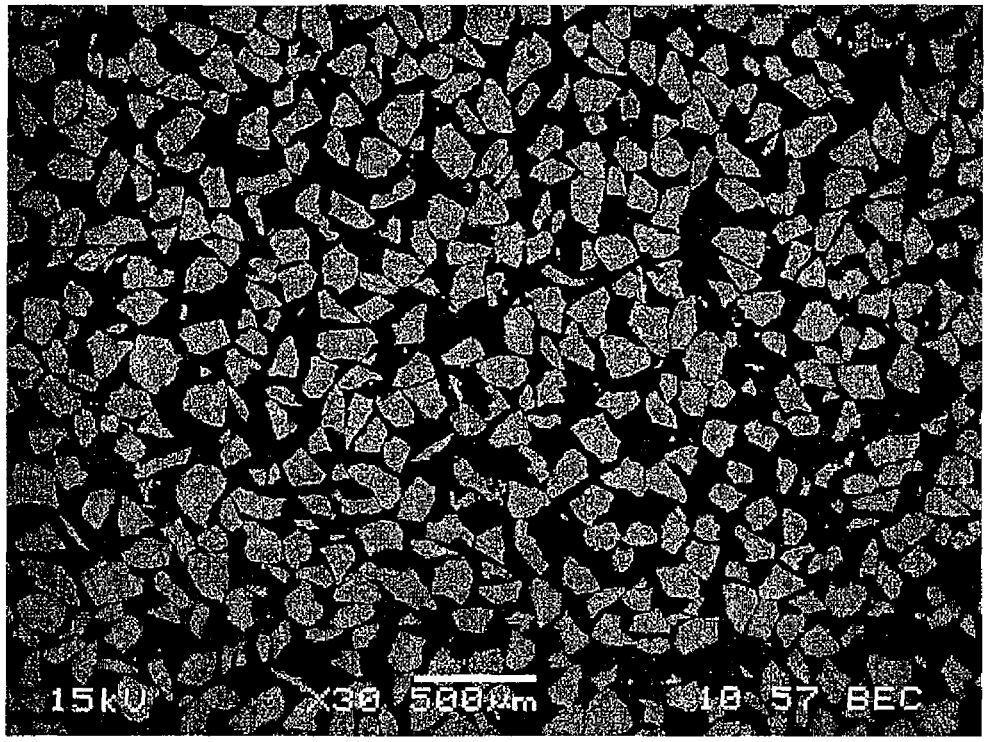
FIG. 2 is an SEM image (30×) of a matrix material in accordance with one embodiment.
Figure 3:
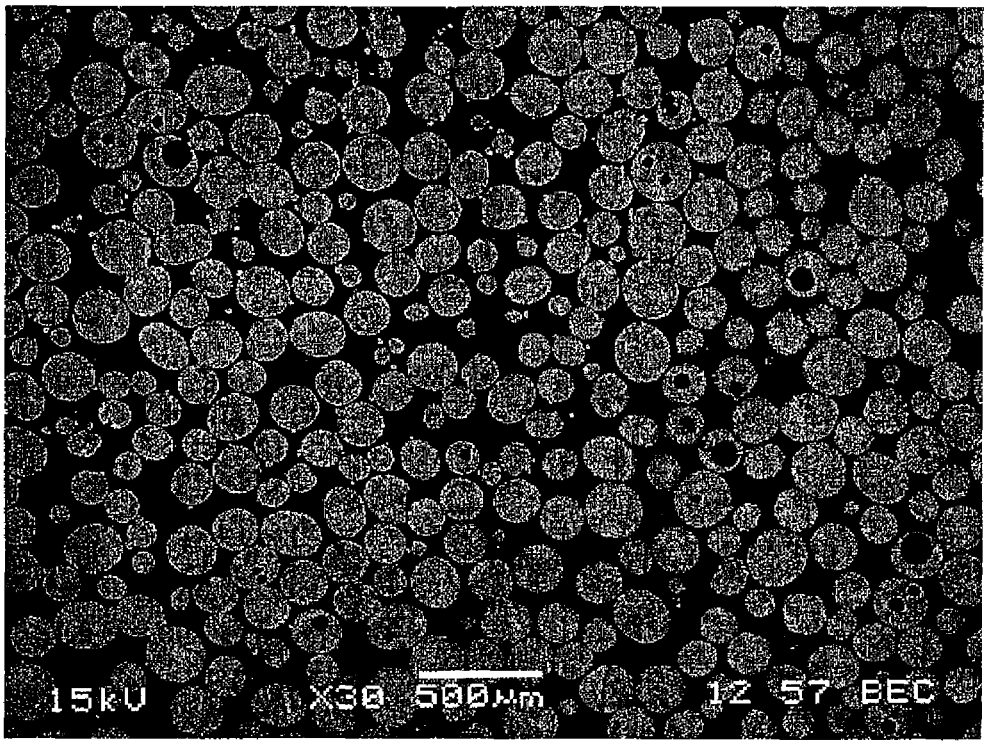
FIG. 3 is an SEM image (30×) of a matrix material in accordance with one embodiment.

A PDC drag bit body manufactured according to one embodiment of the present disclosure is illustrated in FIG. 1A-B. Referring to FIG. 1A, a PDC drag bit body 8 is formed with blades 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made.

Methods of making matrix bit bodies are known in the art and are disclosed for example in U.S. Pat. No. 6,287,360, which is assigned to the assignee of the present invention. These patents are hereby incorporated by reference. Briefly, infiltration processes that may be used to form a matrix bit body of the present disclosure may begin with the fabrication of a mold, having the desired body shape and component configuration. Matrix powder having a narrow size distribution may be loaded into the mold in the desired location, i.e., blades, and the mass of particles may be infiltrated with a molten infiltration binder and cooled to form a bit body. Alternatively, a second matrix powder may be loaded onto the matrix powder having the narrow size distribution, such that a bit body (or blade, as shown in FIG. 1B) may be generally divided into two matrix regions: a first matrix region 10*a* formed from particles of a narrow size distribution (thus forming a low contiguity matrix region) and a second matrix region 10*b* formed from particles without such narrow particle size distribution limitation. In the embodiment shown, the first matrix region 10*a* forms a portion of the outer cutting portion of the blade, whereas the second matrix region 10*b* is layered thereon to form a portion of the base (and gage) of the blade. Further, there is no limitation on the number of or manner in which the layers may be provided in forming the bit.

Further, there is no limitation on the type of second matrix powder that may be used in combination with the matrix powder having a narrow size distribution. For example, while such powder may optionally also have a particle size distribution of ±20% within a median particle size (just having a different mean), it is also within the scope of the present disclosure that such a second powder (for forming a second region) may have a particle size distribution of greater than ±20% of the median. Thus, for example, such powders may include, for example, particles of mesh size as broad as—16+625 or any other mesh size encompassed therein. Further, one skilled in the art would also appreciate that any of the carbide types described above may be used in such second matrix powder for forming a second matrix region.

Figure 4:
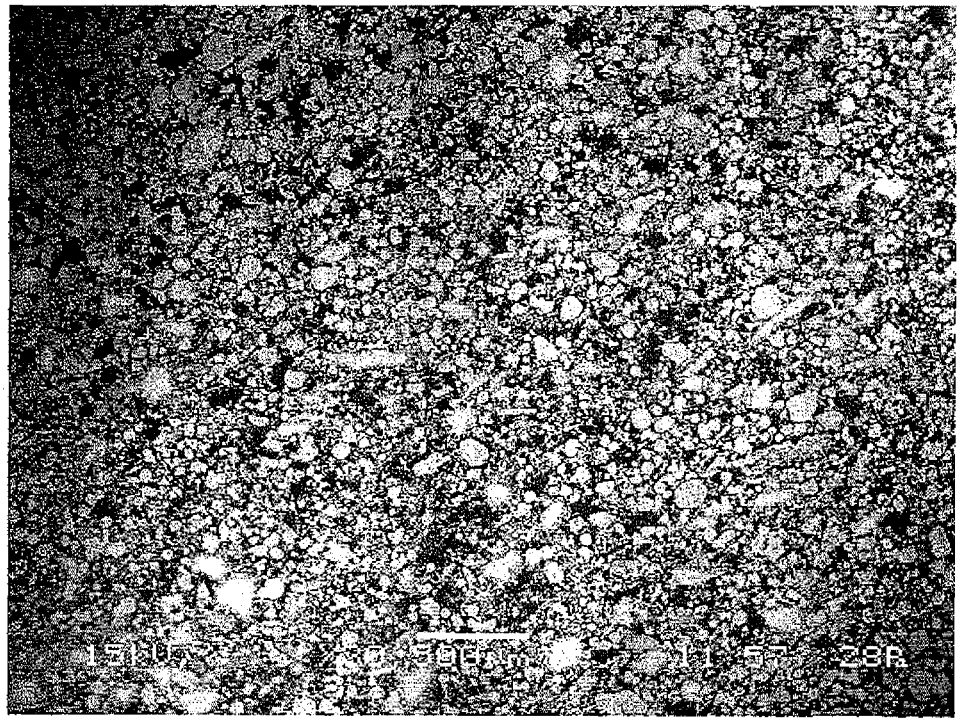
FIG. 4 is an SEM image (30×) of a prior art matrix material.
Figure 5:
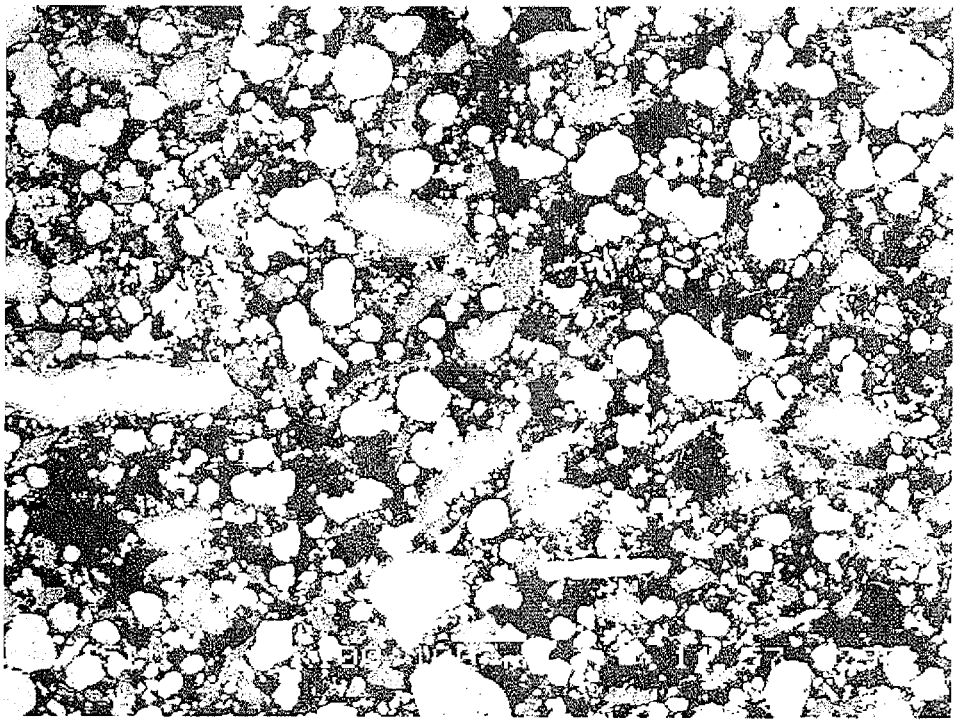
FIG. 5 is a magnified view (100×) of the SEM image shown in FIG. 4.
Figure 6:
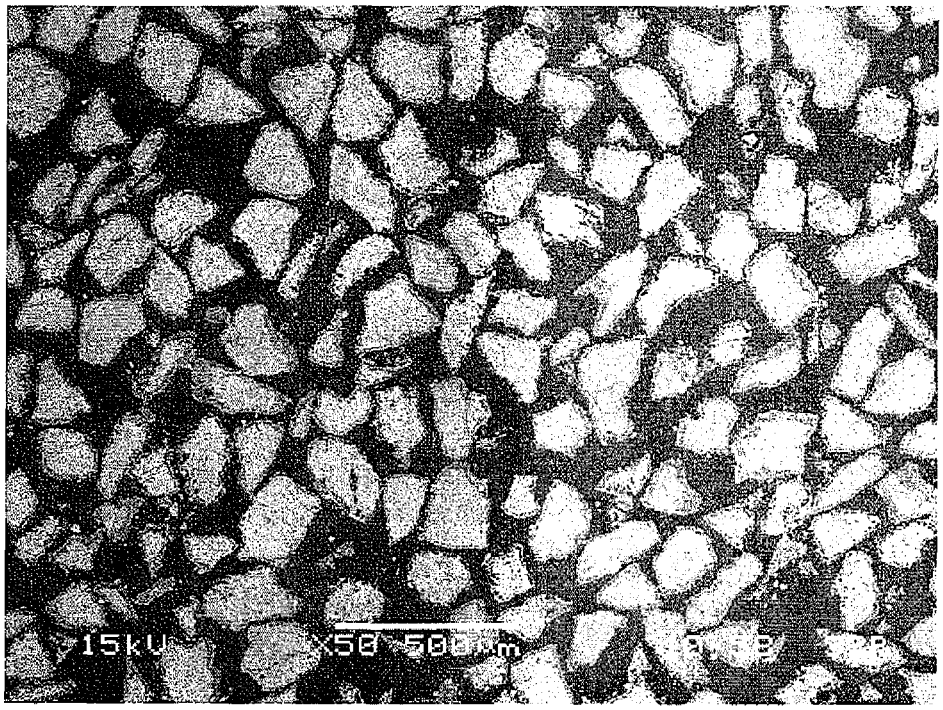
FIG. 6 is an SEM image (50×) of a matrix material in accordance with one embodiment.
Figure 7:
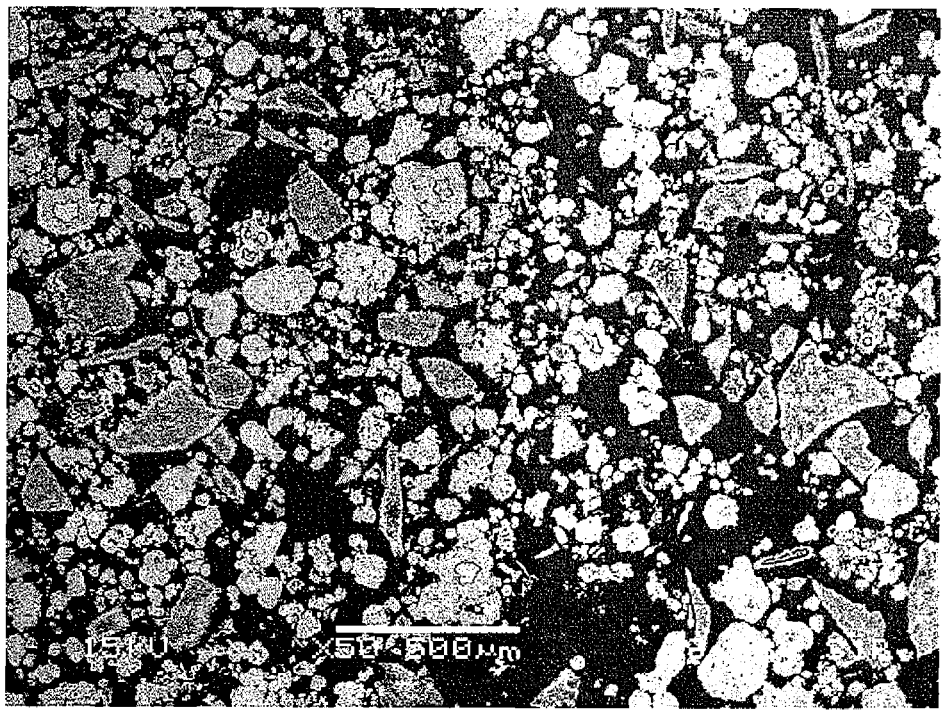
FIG. 7 is an SEM image (50×) of a prior art matrix material.

Referring to FIGS. 2-5, scanning electron microscope images of two embodiments of the present disclosure (FIGS. 2-3) are compared to a prior art matrix material (FIG. 4-5). From the figures, it is apparent that the embodiments of the present disclosure have a relatively uniform particle size whereas the prior art matrix material uses a wide distribution. Further, reduced carbide-carbide contact may be seen for FIGS. 2-3, as compared to FIG. 4-5. Such reduced carbide-carbide contact (and increased mean free path) may be more clearly demonstrated in FIGS. 6-7, which shown a 50× magnification for one embodiment of the present disclosure (FIG. 6), as compared to a prior art matrix body using a wide distribution (FIG. 7), where both bodies possess a similar binder fraction of approximately 44% (by area).

While reference to a particular type of bit may have been made, no limitation on the present invention was intended by such description. Rather, the matrix bodies disclosed herein may specifically find use in PDC drag bits, diamond coring bits, impregnated diamond bits, etc. Thus, it is also within the scope of the present disclosure that at least one cutting element on a diamond impregnated drill bit may include, for example, at least one diamond impregnated insert. Further, any reference to any particular type of cutting element is also not intended to be a limitation on the present invention.

Advantages of the present invention may include one or more of the following. The use of a narrow size distribution of tungsten carbide particles may allow for reduced carbide-carbide contact and a larger mean free path, for a similar binder content. Thus, increased toughness may result from the increased mean free path, while the carbide content (amount of wear particles) may stay roughly the same, give the same or similar wear resistance while achieving increased toughness. Thus, by using a particular size distribution of particles in a single matrix powder, the resulting matrix body (or region) may be advantageously characterized as possessing toughness and strength without impairing wear and erosion resistance, and thus not susceptible to cracking and wear/erosion.

Additionally, bit bodies made in accordance with the present disclosure may also possess reduced (or low) eta phase (brittle complex intermetallics which may precipitate out at high heat), such as less than 5%. Thus, minimization of eta phase may allow for maintenance of increased mean free path values, and reduced carbide-carbide contact (contiguity). These advantages may lead to improved bit bodies for PDC drill bits and other earth-boring devices in terms of longer bit life.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A matrix powder for forming a matrix bit body, the matrix powder consisting essentially of:

a plurality of tungsten carbide particles having a particle size distribution of ±20% or less of a median particle size; and a plurality of metal binder particles;

wherein the plurality of carbide particles comprise at least one of cast tungsten carbide, cemented tungsten carbide, or macrocrystalline tungsten carbide and the mean particle size of the plurality of carbide particles ranges from 50 to 840 microns.

2. The matrix powder of claim 1, wherein the plurality of metal binder particles comprise 8 to 12 wt % of the matrix powder.

3. The matrix powder of claim 1, wherein the plurality of carbide particles comprise at least one of spherical cast tungsten carbide and crushed cast tungsten carbide.

4. A matrix powder for forming a matrix bit body, the matrix powder consisting essentially of:

a plurality of tungsten carbide particles, wherein 90% of the plurality of carbide particles have a particle size within 20% or less of a median particle size of the plurality of carbide particles; and a plurality of metal binder particles;

wherein the plurality of carbide particles comprise at least one of cast tungsten carbide, cemented tungsten carbide, or macrocrystalline tungsten carbide and the mean particle size of the plurality of carbide particles ranges from 50 to 840 microns.

5. The matrix powder of claim 4, wherein the plurality of metal binder particles comprise 8 to 12 wt % of the matrix powder.

6. The matrix powder of claim 4, wherein the plurality of carbide particles comprise at least one of spherical cast tungsten carbide and crushed cast tungsten carbide.

* * * * *